US011143028B2

(12) United States Patent
Mojico

(10) Patent No.: US 11,143,028 B2
(45) Date of Patent: Oct. 12, 2021

(54) COMPOSITE PISTON MACHINE COMBINING ROTARY OSCILLATING AND PENDULAR MOVEMENTS

(71) Applicant: Héctor José Mojico, Mar Azul (AR)

(72) Inventor: Héctor José Mojico, Mar Azul (AR)

( * ) Notice: Subject to any disclaimer, the term of this patent is extended or adjusted under 35 U.S.C. 154(b) by 0 days.

(21) Appl. No.: 17/113,665

(22) Filed: Dec. 7, 2020

(65) Prior Publication Data

US 2021/0180456 A1 Jun. 17, 2021

(51) Int. Cl.
*F01C 11/00* (2006.01)
*F01C 21/08* (2006.01)

(52) U.S. Cl.
CPC ..... *F01C 11/002* (2013.01); *F01C 21/08* (2013.01)

(58) Field of Classification Search
CPC .... F01C 11/002; F01C 21/08; F01C 21/0809; F01C 21/106; F04C 11/001; F04C 2/3442
USPC ..... 123/18 R, 43 A, 45 A, 45 R, 200–249; 418/140, 139
See application file for complete search history.

(56) References Cited

U.S. PATENT DOCUMENTS

2005/0254984 A1* 11/2005 Patterson ..... F01C 21/0863 418/140
2006/0198749 A1* 9/2006 Hwang ..... F04C 28/14 418/140
2007/0089702 A1* 4/2007 Perich ..... F01C 1/3442 123/243

* cited by examiner

*Primary Examiner* — J. Todd Newton, Esq.
(74) *Attorney, Agent, or Firm* — Mariana I. Vernieri

(57) ABSTRACT

A composite piston machine has two moving assemblies of a rotor and a composite piston placed 180° out of phase with each other and linked to a shaft eccentrically placed inside the inner cavity of a main body that has ports for the inlet and outlet of fluids from it. This inner cavity is covered by two lids and divided in two working chambers by a separator. The composite pistons move following the rotation of the rotors while oscillating with respect of them and following the path of skid guides carved in separator and lids, dividing each working chamber in inlet and outlet chambers of variable volume, and intermittently obstructing the inlet and outlet of fluids from the inner cavity through the ports. The machine is designed for compressing gases or pumping liquids and can also operate as an engine driven by compressed gases or with pressurized liquids.

7 Claims, 8 Drawing Sheets

COMPOSITE PISTON MACHINE COMBINING ROTARY OSCILLATING AND PENDULAR MOVEMENTS

CROSS REFERENCE TO RELATED APPLICATIONS

This patent application claims foreign priority under the Paris Convention of the Argentinian Patent Application No. 20190103633, filed on Dec. 12, 2019 the contents of which are incorporated by reference herein.

TECHNICAL FIELD

The present invention relates in general to a piston machine, and, more specifically, to a composite piston machine with combined movements: rotary, oscillating and pendular, which can be designed and used as a pneumatic or hydraulic motor, compressor, hydraulic pump, vacuum pump or similar.

BACKGROUND OF THE INVENTION

In general, and as is known, alternative machines are the most developed and useful in the realization of motors and compressors. Despite this, they have not been able to overcome the problems of low performance, due to friction losses and manufacturing costs caused by the large number of moving parts and in general the complexity of their manufacture.

Among other machines that have had a great degree of development we can mention: turbines, screw, oscillating, swing-piston, Lobe, Wankel, Vane, Scroll, Roots and Diaphragm; those that have not been able to overcome problems and limitations regarding their use, low performance, manufacturing complexity and others of lesser quantity, specific to each one of them.

SUMMARY OF THE INVENTION

The main object of this invention is to obtain a machine with a high volumetric performance for high pressure, with a simple mechanism of high mechanical performance that minimizes the incorporation of lubricant into the circulating fluid.

It is basically a piston machine made up of two parts with combined movements, intended for compressing gases or pumping liquids, which can also operate as an engine driven by compressed gases or by pressurized liquids.

This machine can be calculated and designed to operate as:

A.—Compressor or pump, coupled with different types of motors.

B.—Motor, driven by fluids of different types.

C.—Reversible machine, with the possibility of performing both Functions.

The high mechanical performance of this machine is due to the fact that the few moving parts perform combined movements of low friction and easy lubrication, obtaining sealing surfaces between them and with the fixed parts, of great tightness. The possibility of balancing the machine is favored because the sets of moving parts are arranged at 180° to each other, in their respective working chambers. This allows that even at high revs, vibrations are minimal. The effective work that is achieved in each cycle and the large number of these (R.P.M.), makes it possible to manufacture machines of reduced dimensions in relation with its power and therefore lower manufacturing costs.

The machine can be achieved by combining some or all of the following elements:

a) A main body, inside which an inner cavity formed by two cylindrical sectors is carved, the first cylindrical sector being eccentric with respect to the main body and the second cylindrical sector centered on it.

b) Two lids.

c) A separator that divides the main body into two compartments, obtaining working chambers of equal volume.

d) In each working chamber, one or more rotors, each linked to a shaft, rotate 180° out of phase with each other, both concentric to the first cylindrical sector and at a minimum distance from it, forming closing surfaces that separate the chambers in inlet chambers and outlet chambers of variable volume.

e) The rotors have radially carved piston guides through which the composite pistons, made up of piston bodies and piston heads, move oscillating at each turn, forming two moving assemblies of combined movement both oscillatory and swinging, which makes it possible for the piston head to adapt to the curvature of the second cylindrical sector, forming a closing surface that limits the variable volume chambers.

f) The lids (b) and the separator (c) have carved cavities for bearings and also skid guides, where the skids move, which guide the oscillatory movement of the composite pistons, limiting the action of centrifugal force and maintaining the minimum distance between the inner cavity's surface and the piston heads.

g) On both sides of the first cylindrical sector's surface, on the wall of the main body, the inlet and outlet ports for the propellant or propelled gases or liquids are located.

h) In each cycle of the rotary displacement, each composite piston produces chambers of variable volume, increasing the inlet chamber, and decreasing the outlet chamber and, when passing through the inlet and outlet ports, obstructs the outlet and inlet of driven or impeller gases or liquids.

The most relevant feature of this machine is the mechanical performance that is achieved with minimal friction and the sealing that the inner surfaces of the main body achieve with the rotors and with the composite pistons, which allows to increase the volumetric performance and maximum pressures.

DETAILED DESCRIPTION AND BEST MODE OF IMPLEMENTATION

Figure 1A:
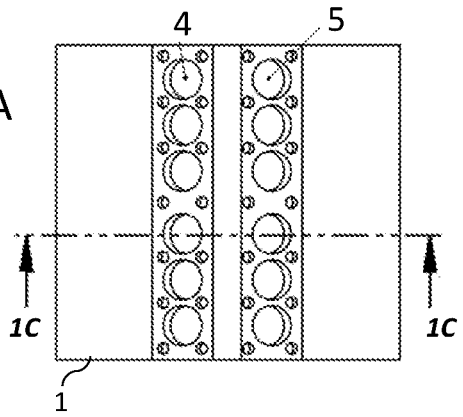
FIG. 1A is a front view of a main body in an embodiment of a composite piston machine in accordance with the present invention.

Disclosed is a composite piston machine that combines three different kinds of movements for an improved performance: rotary, oscillating and pendular. To achieve this, the machine includes a main body having inlet and outlet ports that allow the passage of gasses and/or liquids into and out from a generally cylindrical inner cavity carved inside this main body. This inner cavity is formed by two cylindrical sectors of different center points and radiuses. The first cylindrical sector, which encompasses the shortest area between the inlet and the outlet ports, is eccentric with respect to the main body while the second cylindrical sector, which encompasses the rest of the inner cavity, is centered on it. The machine also includes two lids and a separator that divides the main body into two compartments, obtaining working chambers of equal volume. Each working chamber has inside of it a moving assembly including a rotor, and a composite piston formed by a piston head and a piston body, each moving assembly being symmetrically positioned opposite to one another with respect to the inner cavity's central axis. Both rotors are linked to a shaft and concentric to the first cylindrical sector at a minimum distance from it, forming closing surfaces that separate the chambers in inlet chambers and outlet chambers of variable volume. The rotors have radially carved guides through which the composite pistons move oscillating at each turn forming sets of combined movement both oscillatory and swinging, which makes it possible for the piston head to adapt to the curvature of the second cylindrical sector forming another closing surface that limits the variable volume chambers. At the same time, the lids and the separator have circular guides carved which guide the oscillatory movement of the composite pistons, limiting the action of centrifugal force and maintaining a minimum distance between the inner cavity's surface and the piston heads. In each cycle of the rotary displacement, each composite piston produces chambers of variable volume, increasing the inlet chamber and decreasing the outlet chamber and, when passing through the inlet and outlet ports, obstructing the outlet and inlet of driven or impeller gases or liquids.

Some general aspects of the present invention have been summarized so far in the first part of this detailed description and in the previous sections of this disclosure. Hereinafter, a detailed description of the invention as illustrated in the drawings will be provided. While some aspects of the invention will be described in connection with these drawings, it is to be understood that the disclosed embodiments are merely illustrative of the invention, which may be embodied in various forms. The specific materials, methods, structures, and functional details disclosed herein are not to be interpreted as limiting. Instead, the intended function of this disclosure is to exemplify some of the ways -including the presently preferred ways- in which the invention, as defined by the claims, can be enabled for a Person of Ordinary Skill in the Art. Therefore, the intent of the present disclosure is to cover all variations encompassed within the spirit and scope of the invention as defined by the appended claims, and any reasonable equivalents thereof.

Figure 1B:
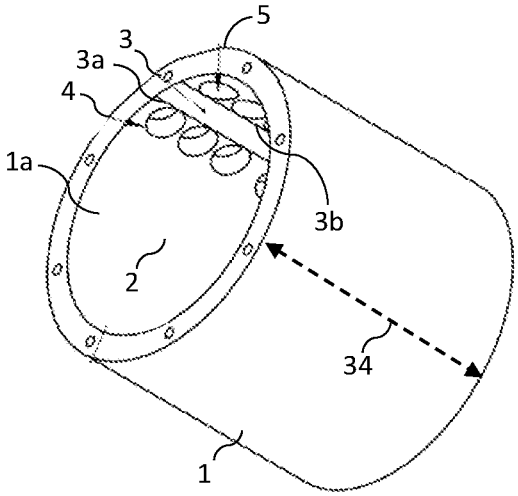
FIG. 1B is a perspective view of a main body in an embodiment of a composite piston machine in accordance with the present invention.

Referring to the drawings in more detail, FIG. 1A illustrates an embodiment of a main body in accordance with the present invention. In this case, the main body 1 itself has a generally cylindrical shape. However, in other embodiments, the shape of this main body 1 may vary without departing from the spirit and scope of the invention. The main body 1 has inlet ports 4 for the entrance of fluids (gasses and/or liquids) to the inner cavity of the main body, and outlet ports 5 to allow the exit of these fluids from this inner cavity 1*a* shown in FIGS. 1B to 1D. These inlet and outlet ports in the illustrated embodiment take the form of six circular holes each, aligned and evenly distributed in the longitudinal direction, but the number, shape and distribution pattern of these holes may vary according to design. As FIG. 1B shows, the inner cavity 1*a* has a generally cylindrical shape defined by two cylindrical sectors: a first cylindrical sector 3 and a second cylindrical sector 2. This second cylindrical sector 2 encompasses most of the surface defined by the inner cavity 1*a*, being at least three times larger in volume than the first cylindrical sector 3, which encompasses only the band of the inner cavity la comprised between the longitudinal straight borders 3*a* and 3*b* that delimit the two cylindrical sectors 2 and 3. The inlet ports 4 are placed contiguously to or encompassing the first longitudinal straight border 3*a* and inlet ports 5 are placed contiguously to or encompassing the second longitudinal straight border 3*b*. Also shown in this figure is the longitudinal direction 34, which is the general direction considered as "longitudinal" for geometrical reference in the present specification and claims.

Figure 1C:
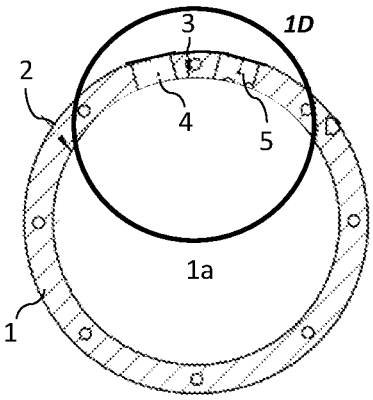
FIG. 1C is a cross-sectional view of a main body in an embodiment of a composite piston machine in accordance with the present invention through FIG. 1A's line "1C/1C".
Figure 1D:
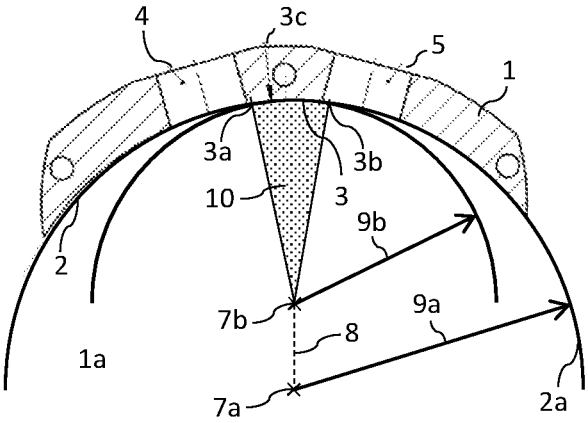
FIG. 1D is a partial enlargement view of FIG. 1C, schematically showing the radiuses, centers, and angles used for the internal carving of the two cylindrical sectors in the main body of an embodiment of a composite piston machine in accordance with the present invention.

FIG. 1C shows a cross-sectional view of the main body of FIG. 1A as seen from line "1C/1C". In it, the inner cavity la can be appreciated in more detail. As well as the inlet ports 4 and the outlet ports 5. FIG. 1D, which is an enlargement of the marked section of FIG. 1C, shows this schematically with more detail. The first cylindrical sector 3 has a first radius 9*b* and a first center point 7*b*, defining a first curvature 3*c*, while the second cylindrical sector 2 has a second radius 9*a* and a second center point 7*a*, defining a second curvature 2*a* which is slightly different from the first curvature 3*c*. The first center point 7*b* is eccentric with respect to said main body 1, and concentric with the shaft 19 and the rotors 6 shown in FIG. 2 and FIG. 3. The second cylindrical sector 2's second center point 7*a* is concentric with the main body 1, and with the lids 11 and the separator 14 shown in FIG. 2 and FIG. 3 among others, marking the geometrical center of the inner cavity 1*a*. From this center point 7*a*, the second radius 9*a* defines the circumference arc of the second cylindrical sector 2, which encompasses the totality of the inner cavity 1*a* with the exception of the area identified with the reference number 10. This area 10 is defined from the center point 7*b*, which is the center of rotation of the rotors, and which is separated from the center point 7*a* by an eccentricity distance 8, and encompassing an angle defined by the longitudinal straight borders 3*a* and 3*b*. In this area 10, the carving of the inner cavity la is made following the first radius 9*b*, which is slightly larger than the rotors' radius 9*c*, shown in FIG. 8B, and marked from the first center point 7*b*, thus defining the first cylindrical sector 3. The second radius 9*a* is slightly greater than the addition of the first radius 9*b* to the eccentricity distance 8. In the shown embodiment, the rotors' depth 6*c* is slightly smaller than the lid-separator distance 32 shown in FIG. 3 and FIG. 4B.

Figure 2:
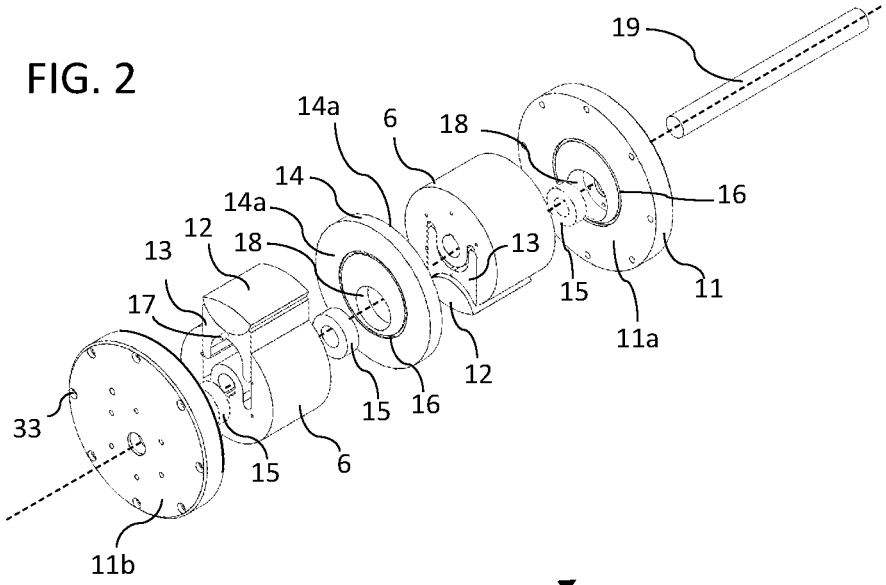
FIG. 2 is an exploded perspective view of the internal elements in an embodiment of a composite piston machine in accordance with the present invention.

FIG. 2 shows an exploded perspective view of a partial assembly of the internal elements in an embodiment of the machine. These internal elements are to be placed inside the inner cavity la of the main body 1, as will be shown in the subsequent figures. The moving parts of the machine include the rotors 6, two "composite pistons" made up of a piston head 12 and a piston body 13, and the bearings 15. The assembly begins and ends with two lids 11 which act as covers of the machine closing said inner cavity 1*a*. These lids 11 have lubricant holes 33, connecting their inner face 11*a* to their outer face 11*b*. In the inner face 11*a*, the lids 11 have bearing cavities 18 for the insertion of the bearings 15 and skid guides 16 to limit the movement of the moving parts by acting as a rail for guiding the skids 17 that are incorporated into the piston heads 13 in order to transit these skid guides 16. In the middle of the assembly, a separator 14 has two faces, 14*a*, a bearing cavity 18 for the insertion of a bearing 15 and skid guides 16 on both sides of the separator 14 for guiding the skids 17 of the piston bodies 13. The rotors 6, together with the bearings 15, the separator 14 and the lids 11 are mounted on a shaft 19. The two moving assemblies of a rotor 6 and a composite piston made up of a piston head 12 and a piston body 13, are placed 180° out of phase with each other.

Figure 3:
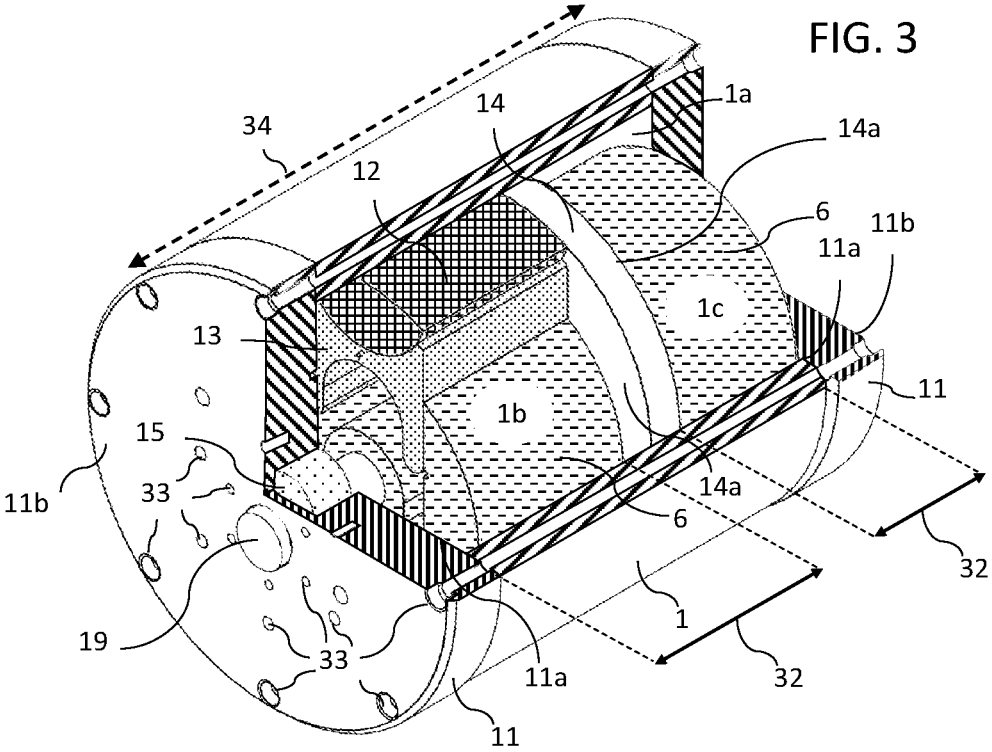
FIG. 3 is a perspective sectional view of the main body and the internal elements in an embodiment of a composite piston machine in accordance with the present invention.

In FIG. 3, the partial assembly of FIG. 2 is put together in place and shown in relation to the main body 1. In it, we can better appreciate how the two moving assemblies of a rotor 6 and a composite piston made up of a piston head 12 and a piston body 13, are placed 180° out of phase with each other and separated by the separator 14. This separator 14 is placed parallelly to the lids 11 and equidistantly form those, so that each of the faces 14*a* of the separator 14 is separated from the lid's inner face 11*a* directly opposed to it by the same distance, called the lid-separator distance 32, thus dividing the inner cavity 1*a* into two equally sized working chambers 1*b* and 1*c*. The placement of the lids 11, as well as the lubricant holes 33 and the arrangement of the pieces around the shaft 19 can also be better appreciated in this view.

Figure 4A:
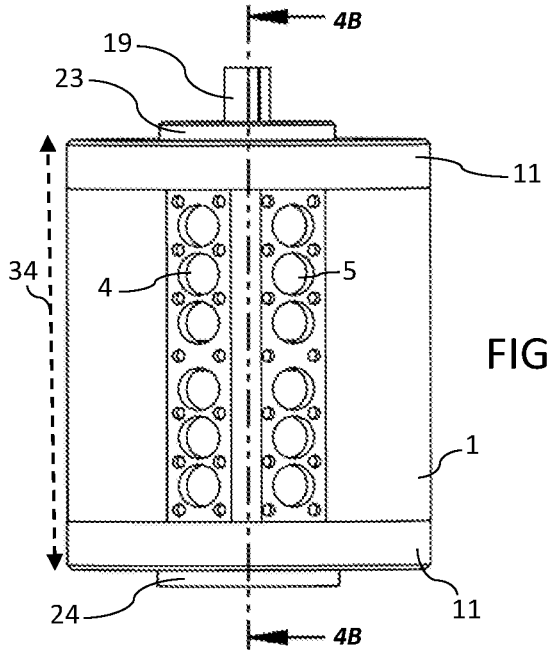
FIG. 4A is a front view of an embodiment of a composite piston machine in accordance with the present invention.
Figure 4B:
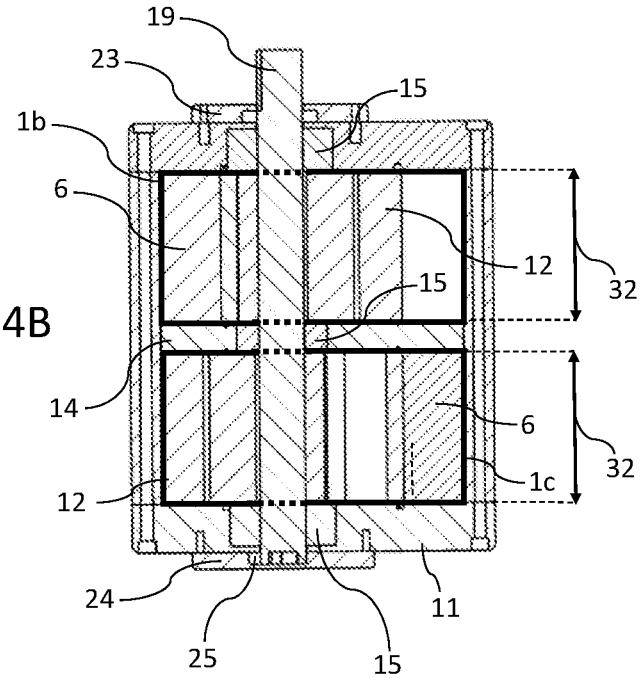
FIG. 4B is a cross-sectional view of an embodiment of a composite piston machine in accordance with the present invention through FIG. 4A's line "4B/4B".

FIG. 4A shows the machine, already assembled, form a front view, where the inlet ports 4 and outlet ports 5 can be appreciated on both sides of the main body 1, while the lids 11 are placed at the top and bottom of it. The shaft 19 is also shown, as well as a shaft seal 23 and an Oil pump body 24 included in this figure. FIG. 4B shows a cross-sectional view of FIG. 4A as seen from line "4B/4B". This view allows for a better appreciation of the internal placement of the rotors 6, the separator 14, the piston bodies 12, the bearings 15 and the shaft 19. Oil pump vanes 25 are also shown. In this figure, the two working chambers 1*b* and 1*c* are shown delimited by a thick line for clarity purposes. Here, it can be best appreciated how the lid-separator distance 32 is the same for both working chambers 1*b* and 1*c*.

Figure 5A:
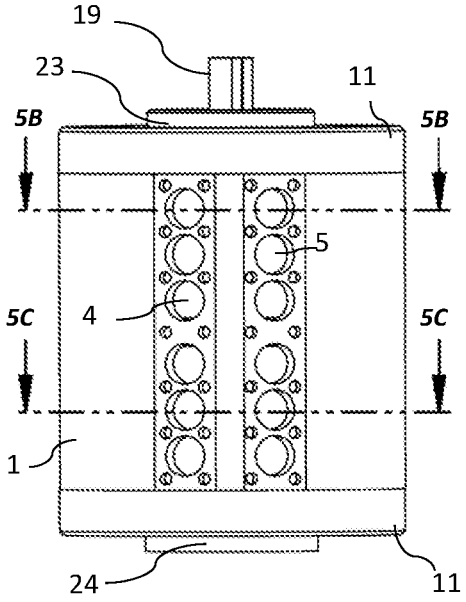
FIG. 5A is a front view of an embodiment of a composite piston machine in accordance with the present invention.
Figure 5B:
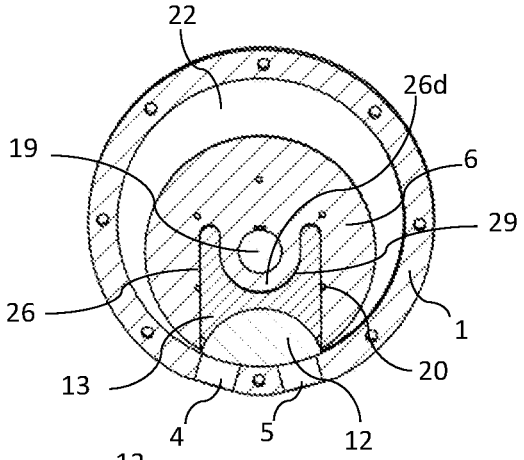
FIG. 5B is a cross-sectional view of an embodiment of a composite piston machine in accordance with the present invention through FIG. 5A's line "5B/5B".
Figure 5C:
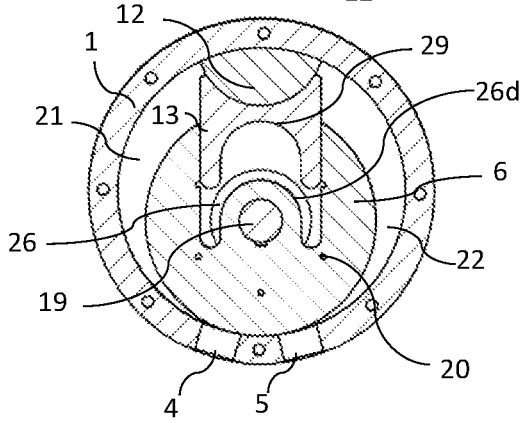
FIG. 5C is a cross-sectional view of an embodiment of a composite piston machine in accordance with the present invention through FIG. 5A's line "5C/5C".

Similarly to FIG. 4A, FIG. 5A shows the machine, already assembled, form a front view, where the inlet ports 4 and outlet ports 5 can be appreciated on both sides of the main body 1, while the lids 11 are placed at the top and bottom of it. In this figure the cut lines "5B/5B" and "5C/5C" are included, from which the cross-sectional views FIG. 5B and FIG. 5C are respectively seen. These two figures show the relative position of the two moving assemblies of a rotor 6 and a composite piston made up of a piston head 12 and a piston body 13, and how they are 180° out of phase with each other. They also illustrate the combined movement of the pistons, given that in FIG. 5B it can be seen how the piston body 13's lower curvature 29 is compressed together with the rotor 6's piston guide 26's top face 26*d*, while in FIG. 5C the piston body 13's lower curvature 29 is uncompressed and separated from the piston guide 26's top face 26*d* of the rotor 6. Moreover, as the piston head 12 of FIG. 5B covers both the inlet ports 4 and the outlet ports 5, in this moment an outlet chamber 22 is generated in which the fluid in its interior will be compressed as the moving assembly of a rotor 6 and a composite piston made up of a piston head 12 and a piston body 13, moves clockwise with a rotative motion of the rotor 6 around the shaft 19, encompassed by the pendular movement of the piston body 13 accompanied by the piston head 12 which slides in a circular fashion following the skid guides 16 in the lid 11 and separator 14, until the moment in which the outlet ports 5 are unblocked, when the compressed fluid will now escape through the outlet ports 5 to the exterior of the machine. On the other hand, as seen in FIG. 5C as the piston head 12 moves clockwise following the skid guides, and as the compressed fluid escapes the outlet chamber 22 through the outlet port 5, the size of the outlet chamber 22 is reduced as the size of an inner chamber 21 is increased. This inlet chamber 21 receives propellant fluids (gases and/or liquids) from the exterior through the inlet ports 4. Both figures also show various lubrication channels 20 located in longitudinal form and around the shaft 19.

Figure 6B:
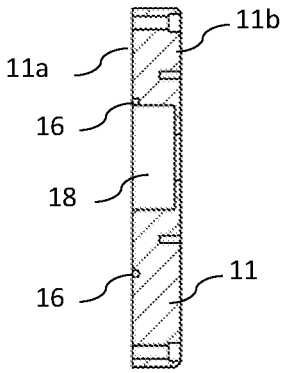
FIG. 6B is a cross-sectional view of a lid in an embodiment of a composite piston machine in accordance with the present invention through FIG. 6A's line "6B/6B".
Figure 6A:
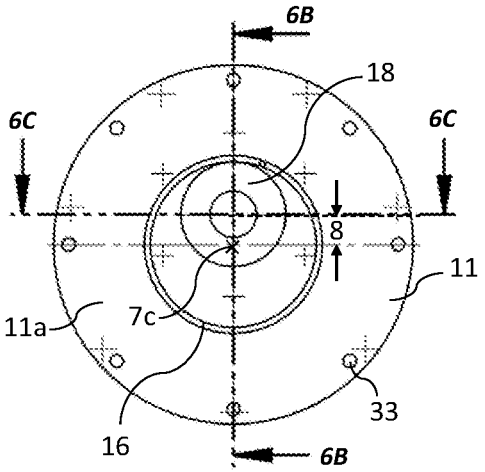
FIG. 6A is a top view of a lid in an embodiment of a composite piston machine in accordance with the present invention.
Figure 6D:
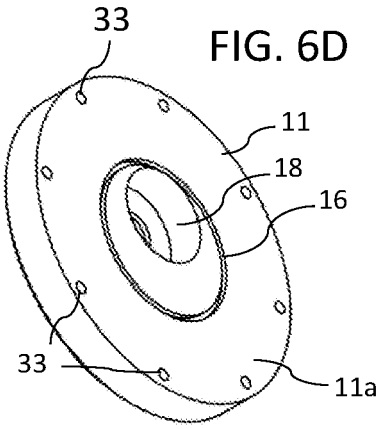
FIG. 6D is a perspective view of a lid in an embodiment of a composite piston machine in accordance with the present invention.
Figure 6C:
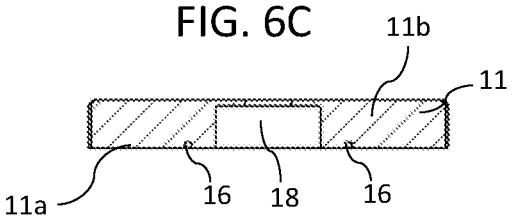
FIG. 6C is a cross-sectional view of a lid in an embodiment of a composite piston machine in accordance with the present invention through FIG. 6A's line "6C/6C".
Figure 9B:
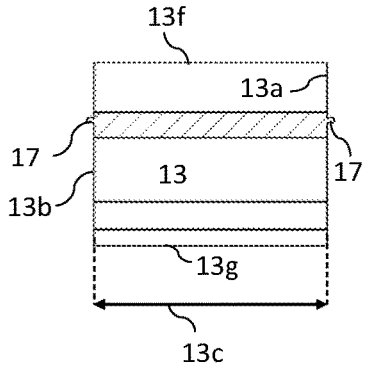
FIG. 9B is a cross-sectional view of a piston body in an embodiment of a composite piston machine in accordance with the present invention through FIG. 9A's line "9B/9B".
Figure 9A:
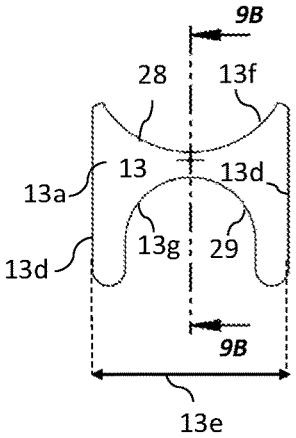
FIG. 9A is a front view of a piston body in an embodiment of a composite piston machine in accordance with the present invention.
Figure 9D:
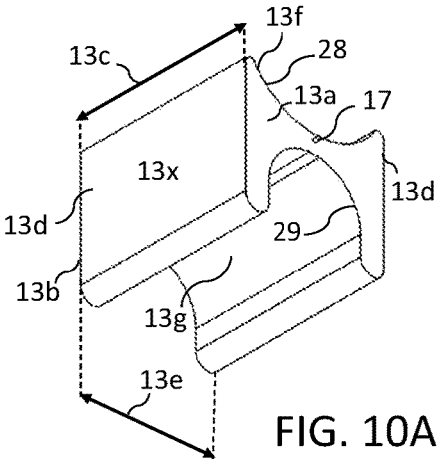
FIG. 9D is a perspective view of a piston body in an embodiment of a composite piston machine in accordance with the present invention.

FIG. 6A shows the top view of a lid 11, in which a bearing cavity 18 is eccentrically carved with the eccentricity distance 8 with respect to the lid's center point 7*c*, and a skid guide 16 is concentrically carved in the lid 11's inner face 11*a* as a guide for the oscillatory movement of the skids 17 of the piston bodies 13, as shown, for example, in FIG. 9D. In FIG. 6A the cut lines "6B/6B" and "6C/6C" are included, from which the cross-sectional views FIG. 6B and FIG. 6C are respectively seen. These two figures allow for a better visualization of the position of the bearing cavity 18 and the skid guide 16. FIG. 6D is a perspective view of the same lid, for a better spatial visualization of all its features.

Figure 7A:
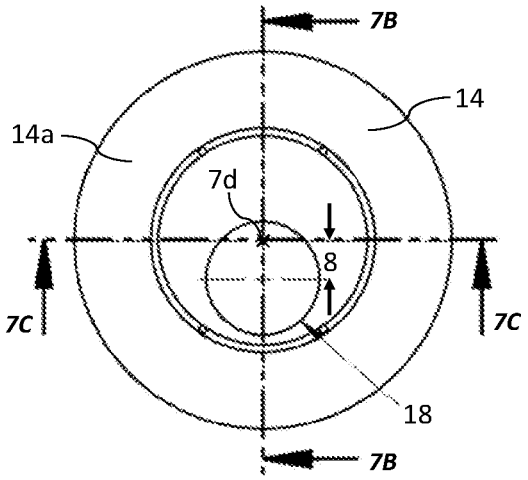
FIG. 7A is a top view of a separator in an embodiment of a composite piston machine in accordance with the present invention.
Figure 7B:
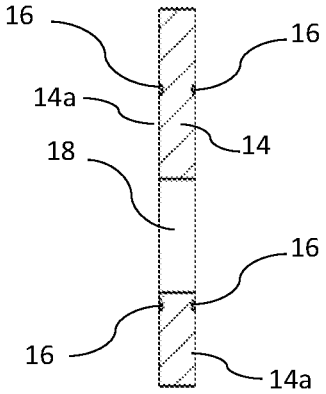
FIG. 7B is a cross-sectional view of a separator in an embodiment of a composite piston machine in accordance with the present invention through FIG. 7A's line "7B/7B".
Figure 7C:
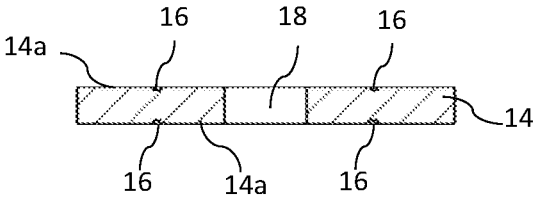
FIG. 7C is a cross-sectional view of a separator in an embodiment of a composite piston machine in accordance with the present invention through FIG. 7A's line "7C/7C".

FIG. 7A shows the top view of a separator 14, in which a bearing cavity 18 is eccentrically carved with the eccentricity distance 8 with respect to the separator's center point 7*d*, traversing the separator from one face 14*a* to the other, and a skid guide 16 is concentrically carved as a guide for the oscillatory movement of the skids 17 of the piston bodies 13, as shown, for example, in FIG. 9D. These carvings are made on both sides 14*a* of the separator 14 nas can be appreciated from FIGS. 7B and 7C. In FIG. 7A, the cut lines "7B/7B" and "7C/7C" are included, from which the cross-sectional views FIG. 7B and FIG. 7C are respectively seen. These two figures allow for a better visualization of the position of the bearing cavity 18 and the skid guides 16.

Figure 8A:
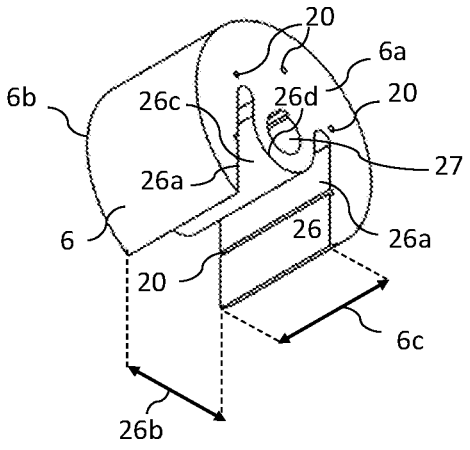
FIG. 8A is a perspective view of a rotor in an embodiment of a composite piston machine in accordance with the present invention.
Figure 8C:
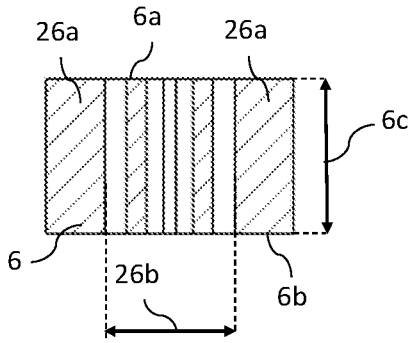
FIG. 8C is a cross-sectional view of a rotor in an embodiment of a composite piston machine in accordance with the present invention through FIG. 8B's line "8C/8C".
Figure 8D:
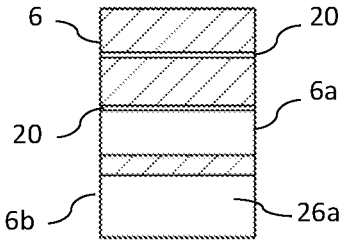
FIG. 8D is a cross-sectional view of a rotor in an embodiment of a composite piston machine in accordance with the present invention through FIG. 8B's line "8D/8D".
Figure 8B:
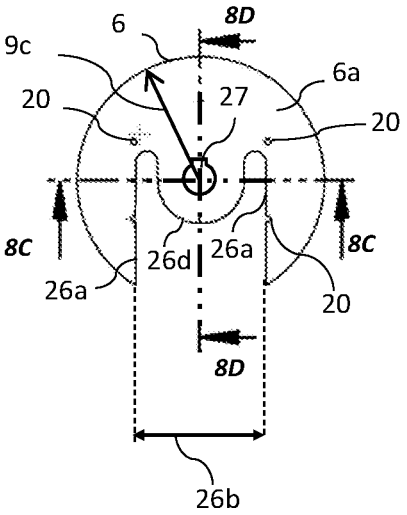
FIG. 8B is a front view of a rotor in an embodiment of a composite piston machine in accordance with the present invention.

FIG. 8A is a perspective view of a rotor 6 which has a basically cylindrical shape having a front face 6*a* separated from a rear face 6*b* by a depth 6*c*. The rotor also has a centric hole 27 and keyway to fix it on the shaft 19, traversed longitudinally by holes that are lubrication channels 20 and a with radial groove, which contains and functions as a piston guide 26, formed by two flat lateral faces 26*a*, parallel to one another, defining a width 26*b*, and by a top face 26*c* having an inner curvature 26*d*. FIG. 8B is a front view of this rotor which, besides the elements mentioned above, includes the cut lines "8C/8C" and "8D/8D", from which the cross-sectional views FIG. 8C and FIG. 8D are respectively seen. These figures allow for a more complete visualization of the shape of the rotor 6 and the location of the lubrication channels 20.

FIG. 9A is a front view of a piston body 13 that has a flat front face 13*a* facing a flat rear face 13*b* and so defining a depth 13*c*, as shown in FIG. 9B. Perpendicularly to these, two flat lateral faces 13*d* are shown, parallel to one another, defining a width 13*e*. The geometry of the piston body 13 is completed by a concave top face 13*f* having an upper curvature 28, opposite to a concave bottom face 13*g* having a lower curvature 29. In the shown embodiment, the upper curvature 28 is similar to the piston head 12's lower curvature 31, as shown in FIGS. 10A and 10D, and the lower curvature 29 is similar to the inner curvature 26*d* of the rotor 6's piston guides 26's top face 26*c* shown in FIGS. 8A and 8B.

Figure 9C:
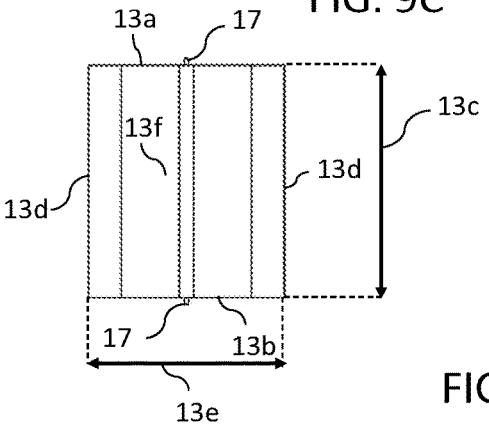
FIG. 9C is a top view of a piston body in an embodiment of a composite piston machine in accordance with the present invention.

FIG. 9B shows a cross-sectional view of FIG. 9A as seen from line "9B/9B", in which the skids 17 can be noticed on both the front face 13*a* and the rear face 13*b* of the piston body 13. These skids 17 limit the oscillatory movement of the composite pistons. FIG. 9C shows the piston head 13 from the top, for a better visualization of the skids 17, while FIG. 9D shows it in perspective for a more complete visualization of the shape of the piston body 13 and the location of its upper curvature 28, its lower curvature 29, and the skids 17. The piston body 13's width 13*e* is slightly shorter than the rotor 6's piston guides 26's width 26*b* shown in FIGS. 8A to 8D. Similarly, the piston body 13's depth 13*c* is similar to the rotor 6's depth 6*c* shown in FIGS. 8A and 8C and to the piston head 12's depth 12*c* shown in FIGS. 10A to 10C and slightly shorter than the lid-separator distance 32 shown in FIGS. 3 and 4B. The piston body 13's lower curvature 29 is similar to the rotor 6's inner curvature 26*d* shown in FIGS. 8A and 8B and the piston body 13's upper curvature 28 is similar to the piston head 12's lower curvature 31 shown in FIGS. 10A and 10D.

Figure 10A:
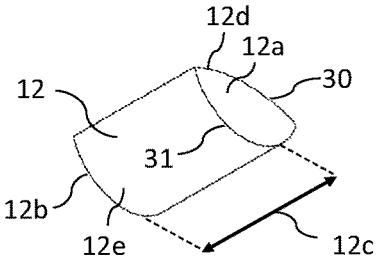
FIG. 10A is a perspective view of a piston head in an embodiment of a composite piston machine in accordance with the present invention.
Figure 10B:
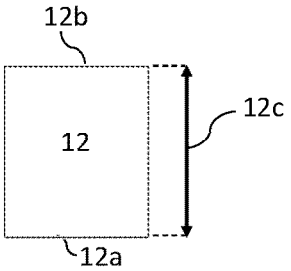
FIG. 10B is a top view of a piston head in an embodiment of a composite piston machine in accordance with the present invention.
Figure 10C:
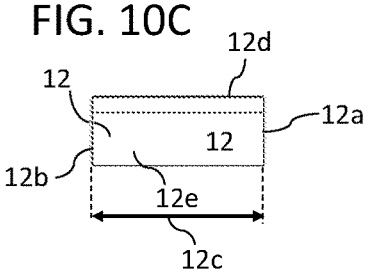
FIG. 10C is a side view of a piston head in an embodiment of a composite piston machine in accordance with the present invention.
Figure 10D:
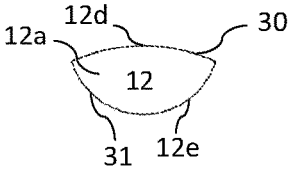
FIG. 10D is a front view of a piston head in an embodiment of a composite piston machine in accordance with the present invention.

FIG. 10A is a perspective view of a piston head 12 that has a flat front face 12*a* facing a flat rear face 12*b*, defining a depth 12*c*, and completed by a convex top face 12*d* that has an upper curvature 30, similar to the second curvature 2*a* of the main body 1's inner cavity 1*a* as shown in FIGS. 1B to 1D, and opposite to a convex bottom face 12*e* that has a lower curvature 31 similar to the piston body 13's upper curvature 28, as shown in FIGS. 9A and 9D. FIG. 10B is a top view of this piston head, while FIG. 10C shows it from the side and FIG. 10D shows it from the front, for a more complete visualization of the shape of the piston head 12 and the location of its upper curvature 30 and its lower curvature 31.

The description as set forth is not intended to be exhaustive or to limit the invention to the precise form disclosed. Many modifications and variations are possible in light of the teachings above without departing from the spirit and scope of the forthcoming claims.

What is claimed and desired to be secured by patent is as follows:

1. A composite piston machine comprising:

a. a main body comprising an inner cavity and the main body defining one or more inlet ports allowing for inlet of fluids to said inner cavity and defining one or more outlet ports allowing for outlet of said fluids from said inner cavity;

b. two lids closing said inner cavity, each lid having an inner face, and an outer face, each said inner face comprising a skid guide and a bearing cavity;

c. a separator having two faces each facing an opposing inner face of one of the two lids and each separated from the opposing inner face of one of the two lids by a lid-separator distance, said separator dividing said inner cavity into two working chambers, said separator comprising a skid guide on each face, and a separator bearing cavity traversing the separator from one face to the other;

d. three bearings, one of these bearings inserted in each lid bearing cavity and one bearing disposed in the separator;

e. a shaft linked to said three bearings;

f. in each of said two working chambers, a rotor having a radius and a depth, each said rotor being linked to said shaft 180° out of phase with the other rotor; and g. in each of said two working chambers, a composite piston comprising a piston head and a piston body, said piston body having two skids, said piston body inserted within a piston guide radially carved in each said rotor, and said skids inserted in said piston guides, said piston heads separating said working chambers into inlet chambers and outlet chambers of variable volume;

wherein said rotors move linked to said shaft and impulsed by said composite pistons whose skids follow the path of said piston guides, altering the volume of said inlet and outlet chambers and intermittently obstructing inlet and outlet of said fluids from said inner cavity.

2. The composite piston machine of claim 1 wherein said separator and said lids each further comprise a plurality of lubricant holes.

3. The composite piston machine of claim 1 wherein said inner cavity is delimited by two cylindrical sectors delimited by two longitudinal straight borders, said two longitudinal straight borders being a first border and a second border, those two cylindrical sectors being a first cylindrical sector having a first radius and a first center point defining a first curvature, said first center point being eccentric with respect to said main body and concentric with said shaft and said rotors, and a second cylindrical sector being at least three times larger in volume than the first cylindrical sector, said second cylindrical sector having a second radius and a second center point defining a second curvature, said second center point being concentric with said main body, said lids and said separator, wherein said first center point is separated from said second center point by an eccentricity distance, wherein said first radius is slightly larger than the rotor radius and said second radius is slightly greater than the addition of said first radius to said eccentricity distance, and wherein said inlet ports are located in the second cylindrical sector contiguously to said first border and said outlet ports are located in the second cylindrical sector contiguously to said second border.

4. The composite piston machine of claim 3 wherein all said skid guides are circular and concentric with said second cylindrical sector and all said bearing cavities are circular and concentric with said first cylindrical sector.

5. The composite piston machine of claim 3 further comprising a plurality of lubrication channels located in longitudinal form and around the shaft, wherein said rotor radius is less than said first radius and said rotor depth is less than said lid-separator distance.

6. The composite piston machine of claim 2 wherein:

a. each piston head comprises a flat front face facing a flat rear face, defining a depth, completed by a convex top face having an upper curvature opposite to a convex bottom face having a lower curvature;

b. each piston body comprises a flat front face facing a flat rear face defining a depth, perpendicular to two flat lateral faces, parallel to one another, defining a width, and completed by a concave top face having an upper curvature opposite to a concave bottom face having a lower curvature; and c. each rotor has a cylindrical shape having a front face separated from a rear face by said rotor depth, and said rotor piston guide comprises two flat lateral faces. parallel to one another defining a width, and a top face having an inner curvature;

wherein said piston body width is less than the width of said piston guides, said piston body depth is said rotor depth and to said piston head depth and shorter than the lid-separator distance, said skids are located on said piston body's front and rear faces, said piston body lower curvature approximates the rotor piston guides inner curvature and said piston body upper curvature approximates the piston head lower curvature.

7. The composite piston machine of claim 6 wherein each piston head upper curvature approximates said inner cavity's second curvature.

* * * * *